US006536256B2

(12) United States Patent
Hauger

(10) Patent No.: US 6,536,256 B2
(45) Date of Patent: Mar. 25, 2003

(54) METHOD AND DEVICE FOR FORMING COMPONENTS FROM BILLETS OF A FLEXIBLY ROLLED METAL BAND

(75) Inventor: Andreas Hauger, Aachen (DE)

(73) Assignee: Muhr und Bender KG, Attendorn (DE)

( * ) Notice: Subject to any disclaimer, the term of this patent is extended or adjusted under 35 U.S.C. 154(b) by 27 days.

(21) Appl. No.: 09/933,727

(22) Filed: Aug. 22, 2001

(65) Prior Publication Data

US 2002/0023475 A1 Feb. 28, 2002

(30) Foreign Application Priority Data

Aug. 22, 2000 (DE) ..... 100 41 281

(51) Int. Cl.[7] ..... B21J 13/02

(52) U.S. Cl. ..... 72/348; 72/377

(58) Field of Search ..... 72/343, 348, 352, 72/358, 359, 377

(56) References Cited

U.S. PATENT DOCUMENTS 873,297 A * 12/1907 Chillingworth ..... 72/348
2,917,823 A * 12/1959 Fletcher ..... 72/358

* cited by examiner

*Primary Examiner*—Lowell A. Larson
(74) *Attorney, Agent, or Firm*—Nixon Peabody LLP; David S. Safran

(57) ABSTRACT

A device for forming components from billets having a thickness profile which is essentially symmetric to the central plane of the billet, i.e., the billet contains a thickness transition on both sides, and wherein the thickness transitions on both sided of the billet are transferred to one side of the formed such that the side of the formed component is planar. The forming surface of the forming device which faces the side of the billet that has a thickness transition in the formed state of the billet has a shape is adapted to the thickness transition to be realized, and the forming surface of the forming device which faces the side of the billet that becomes planar in the formed state is planar. Due to these measures, it is possible to transfer the thickness transition that originally existed on both sides of the billet to one side of the billet in only one step.

17 Claims, 1 Drawing Sheet

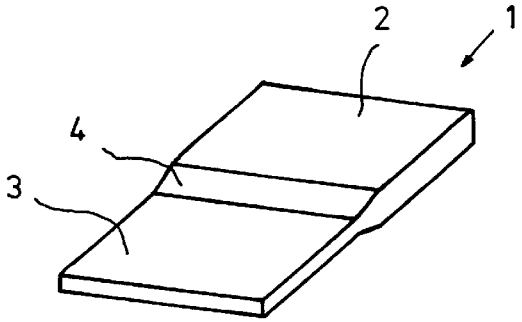
Fig. 1
Fig. 2B
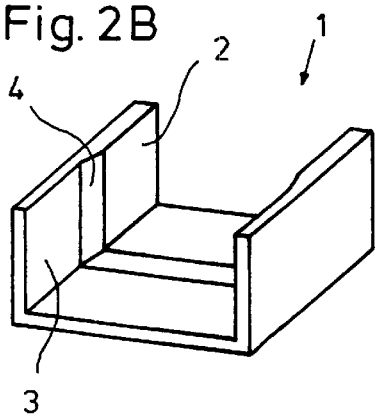
Fig. 2A
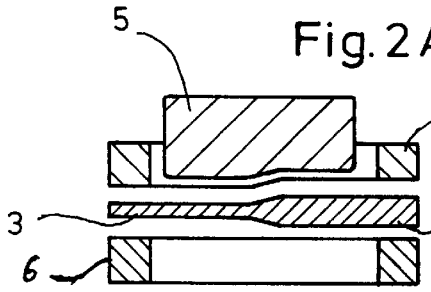
Fig. 2C
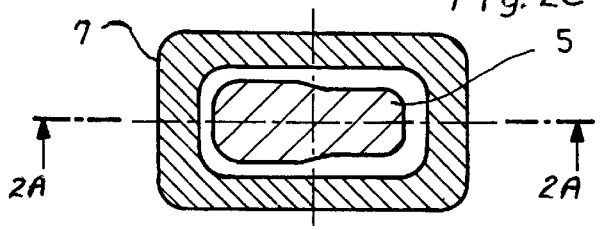
Fig. 3B
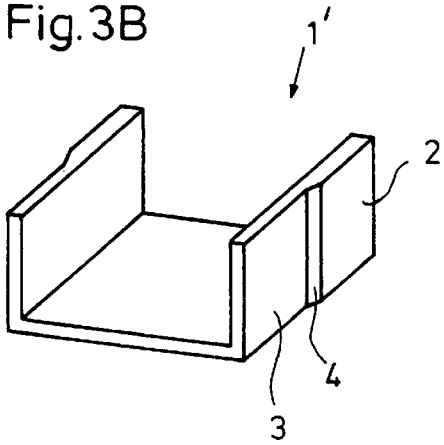
Fig. 3A
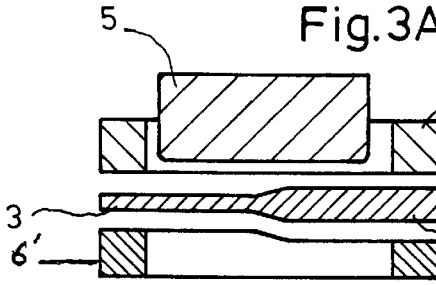
Fig. 3C
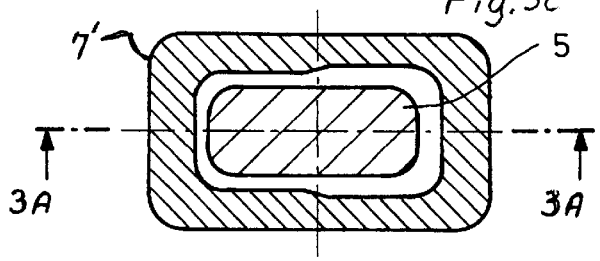

METHOD AND DEVICE FOR FORMING COMPONENTS FROM BILLETS OF A FLEXIBLY ROLLED METAL BAND

BACKGROUND OF THE INVENTION

1. Field of the Invention

The present invention pertains to a device for forming billets made from a flexibly rolled metal band which has at least two different thicknesses and the thickness profile of the billet essentially extends symmetric referred to the central plane of the billet, i.e., the billet contains a thickness transition on both sides, and wherein the thickness transitions are transferred to only one side of the component formed from the billet such that one side of the formed component has a thickness transition and the other side of the formed component is planar. The invention also pertains to a method for forming such billets into such components.

2. Description of Related Art

The billet in question consists of a work piece that is manufactured by flexibly rolling a metal band and subsequently separating the metal band into billets. The flexible rolling method for manufacturing metal bands with band thicknesses that differ over its length in a defined fashion is well known from practical applications and characterized by varying the roll gap in a targeted fashion during the rolling process. In this case, differently long band sections with different band thicknesses are rolled, wherein these band sections may be connected to one another by different inclines such that band thickness transitions are correspondingly produced on both sides. The purpose of the flexible rolling method consists of manufacturing rolled products with cross-sectional shapes that are optimized with respect to the load carrying capacity and the weight. This method is usually realized by rolling the band from coil to coil.

Billets obtained by separating flexibly rolled metal bands consequently have a thickness profile with at least two thicknesses that differ from one another, wherein the regions with different thicknesses are connected to one another by a region that has a predetermined incline, i.e., a band thickness transition. These billets are usually used for manufacturing components with varying wall thicknesses. In this case, the billets typically have a thickness profile that is symmetric referred to the central plane of the billets before they are additionally processed into components with varying wall thicknesses. However, the components to be manufactured from these billets frequently should contain thickness transitions on only one side. For example, when manufacturing a deep-drawn component, only an inner thickness transition or several inner thickness transitions or only an outer thickness transition or several outer thickness transitions should be produced while the respectively other side of the deep-drawn component, i.e., the outer side or the inner side of the deep-drawn component, should be plane. In this case, it is necessary to transfer the thickness transitions that originally existed on both sides to one side of the billet such that one side of the formed billet contains a thickness transition and the other side of the formed billet is plane.

In accordance with the state of the art, the elimination of an undesirable thickness transition or several undesirable thickness transitions is only possible in a separate additional step that either needs to be carried out on the billet that is not yet formed, i.e., before the deep-drawing process, or on the component obtained by means of the deep-drawing process, i.e., after the deep-drawing process. In other words, two steps that differ from one another and need to be carried out successively are required in a device in which the billet is not only subjected to a deep-drawing process, but in which a transfer of the thickness transitions that originally existed on both sides to one side of the billet needs to be realized. This means that the device and the corresponding method are complicated and expensive.

SUMMARY OF THE INVENTION

The present invention is based on the objective of providing a method and a device for forming a billet of a flexibly rolled metal band which make(s) it possible to transfer the thickness transitions that originally existed on both sides to one side of the billet in only one step on billets with a thickness profile that essentially extends symmetric with reference to the central plane of the billet, namely such that one side of the formed billet contains a thickness transition and the other side of the formed billet is planar.

The device in accordance with the present invention for forming billets of a flexibly rolled metal band and for attaining the above-mentioned objective essentially is characterized by the fact that the forming surface of the forming device which faces the side of the billet that should contain a thickness transition in the formed state of the billet has a shape that is adapted to the thickness transition to be realized, and by the fact that the forming surface of the forming device which faces the side of the billet that should be plane if the formed state of the billet is plane.

Both sides of the billet manufactured by flexibly rolling a metal band consequently are changed during the forming process in such a way that the thickness transitions which originally existed on both sides are transferred to one side in the same step as the forming process. This means that a thickness transition only exists on one side of the formed work piece, i.e., the formed billet, while the other side is plane. This thickness transition is greater than in the unformed state of the billet, namely twice as large. Although the previous description states that one side of the work piece is plane after the forming process, this does not mean that this side completely lies in one plane. This merely means that no thickness transition exists any longer on this side. For example, if the work piece was, in particular, formed into a deep-drawn component by means of a deep-drawing process, the side of the formed work piece which can also be referred to as the plane side naturally no longer lies completely in one plane, but rather protrudes from the original plane that corresponds to one side of the billet because a deep-drawn component usually consists of a three-dimensional structure. In this respect, the term "plane" should be understood as the opposite to the state of one side of the work piece in which this side contains a thickness transition.

The forming device is, in principle, suitable for all known forming methods that serve for forming sheets. Consequently, the invention is also suitable for all conventional types of forming devices. In accordance with one preferred additional development of the invention, it is, however, proposed that the forming devices contain a die and a female mold that cooperate with one another in order to form the work piece. When forming a work piece, the die and the female mold usually cooperate in such a way in that a frame with an opening that is surrounded by the frame is formed by the female mold, wherein the work piece to be formed, i.e., the flexibly rolled billet, lies on the frame such that the region of the billet which lies above the opening of the female mold can be pressed into the opening of the female mold by the die while subjecting the billet to a plastic deformation. Such a combination of a die and a female mold is, for example, used in deep-drawing methods.

Two forming devices, e.g., one die and one female mold, essentially suffice for carrying out the forming method in question. However, one preferred additional development of the invention proposes that the forming devices also contain a holding-down appliance, and that the holding-down appliance has a shape that is adapted to the thickness transition if it is arranged on the side of the work piece which should contain a thickness transition in the formed state, wherein the holding-down appliance is plane if it is arranged on the side of the work piece which should be plane in the formed state of the work piece. Consequently, the holding-down appliance is subject to exactly the same requirements as the other forming devices, e.g., the dye and the female mold, namely that the thickness transitions that originally existed on both sides are transferred to only one side during the forming process due to the shape of the respective component which is either adapted to the thickness transition to be realized or plane.

In one preferred embodiment of the invention in which a die and a female mold are provided as forming devices, the holding-down appliance preferably is arranged on the side of the billet which corresponds to the die such that the holding-down appliance is able to cooperate with the female mold in order to hold down the work piece. This specifically means that the work piece is clamped between the holding-down appliance and the female mold due to the cooperation between the holding-down appliance and the female mold. When processing work pieces with, in particular, a low stiffness, these measures ensure that the work piece cannot completely slide into the opening of the female mold when the die presses the work piece into the opening of the female mold.

In the previous description, it was always stated that the forming device or the forming devices, specifically the corresponding forming surface or the corresponding forming surfaces, which face(es) the side of the work piece that should contain a thickness transition in the formed state of the work piece has/have a shape that is adapted to the thickness transition. A shape of the forming surface of the forming device which is adapted to the thickness transition to be realized is generally utilized if the progression of the forming surface of the forming device exactly corresponds to the obtained progression of the surface of the formed work piece. This means that the surface of the formed work piece is provided with exactly the shape defined by the shape of the forming surface of the forming device. At least slight deviations from this rule are permissible, in particular, in the presence of upsetting effects or hysteresis effects.

With respect to the precise dimensions of the forming surface of a forming device which faces the side of the work piece that should contain a thickness transition in the formed state of the work piece, the general rule applies that, if thickness transitions of a respective thickness d originally existed on both sides of the billet, the forming surface of the forming device needs to contain a thickness transition of essentially the thickness 2*d*.

In accordance with the invention, a device of the previously described type is preferably used for a high-pressure sheet forming method, a tension forming method or a tension and compression forming method, in particular, for a deep-drawing method, a stretch-forming method or a pressing method. However, a device in accordance with the invention naturally is also suitable for all other forming methods that operate with two cooperating forming devices.

The method in accordance with the invention for forming billets consisting of a flexibly rolled metal band and for attaining the above-mentioned objective essentially is characterized by the fact that the thickness transitions are transferred to one side of the billet in the step in which the forming of the billet takes place. This is, in particular, possible due to the fact that the transfer of the thickness transition to one side of the billet and the forming of the billet are realized with the same forming devices. Other preferred additional developments of the method in accordance with the invention are realized analogous to the previously described preferred embodiments of the device in accordance with the invention.

There exist various options for designing and additionally developing the device in accordance with the invention and the method in accordance with the invention as will become apparent from the following detailed description of preferred embodiments of the invention in conjunction with the accompanying figures of the drawings.

BRIEF DESCRIPTION OF THE DRAWINGS

FIG. 1 is a perspective representation of a billet with thickness transitions on both sides which was manufactured by flexibly rolling a metal band and subsequently separating the metal band into billets;

FIG. 2A is a schematic representation of the essential components of a device for manufacturing a deep-drawn component with an inner thickness transition in accordance with a first preferred embodiment of the invention in a longitudinal sectional view taken along line 2A—2A of FIG. 2C;

FIG. 2B is a deep-drawn component with an inner thickness transition which was manufactured with the device that is schematically illustrated in FIG. 2A;

FIG. 2C is a schematic representation of components of a device for manufacturing a deep-drawn component with an inner thickness transition in accordance with a first preferred embodiment of the invention in a horizontal sectional view;

FIG. 3A is a schematic representation of the essential components of a device for manufacturing a deep-drawn component with an outer thickness transition in accordance with a second preferred embodiment of invention in a longitudinal sectional view taken along line 3A—3A of FIG. 3C;

FIG. 3B is a deep-drawn component with an outer thickness transition which was manufactured with the device that is schematically illustrated in FIG. 3A; and FIG. 3C is a schematic representation of components of a device for manufacturing a deep-drawn component with an outer thickness transition in accordance with a second preferred embodiment of the invention in a horizontal sectional view.

DETAILED DESCRIPTION OF THE INVENTION

FIG. 1 shows a perspective representation of a billet 1 that was manufactured by flexibly rolling a metal band and subsequently separating the metal band into billets, wherein the billet contains two different regions, namely a region 2 and a region 3 with different thicknesses. The region 2 is respectively separated from the region 3 on both sides of the billet 1 by a thickness transition 4 that produces the transition from the thickness of the region 2 to the thickness of the region 3 with a predetermined incline.

A first preferred embodiment of a device for forming a billet in accordance with FIG. 1 is schematically illustrated in FIGS. 2A & 2C. With respect to the device shown in FIGS. 2A & 2C, as well as the devices shown in FIGS. 3A & 3C, only components that are essential for the invention are illustrated. This means that components of the devices which are analogously provided in conventional devices for forming work pieces formed of sheets are not shown; for example, a platen for supporting the female mold and a drive device for displacing the male die member would be provided in a known manner.

The device in accordance with the first preferred embodiment of the invention includes a die 5 and a female mold 6, between which the billet 1 to be formed is arranged. In order to hold the billet 1 for the forming process, a work immobilizer or clamp 7 is provided for fixing the billet 1 on the female mold 6. This ensures that the billet 1 does not completely slide into the opening of the female mold 6 during the forming process.

FIG. 2A shows that the billet 1 has two regions 2, 3 with different thicknesses, wherein the thickness profile of the billet 1 is symmetric with reference to the central plane of the billet 1. The device shown in FIG. 2A is intended for manufacturing a component, namely a deep-drawn component, that contains only an inner thickness transition 4 and has completely planar surfaces on its outer side. For this purpose, the female mold 6 is designed in such a way that its surface which contacts the billet 1 during the forming process, i.e., the forming surface of the female mold 6 or a platen on which an annular female mold sits, lies completely in one plane. The opening formed by the female mold 6 has, with the exception of the rounded edges, an essentially rectangular shape; see, FIG. 2C. The forming surfaces of the die 5 and the clamp 7, in contrast, have a shape that is adapted to the thickness transitions 4 to be realized on the billet 1. This means that the forming surface that contacts the billet 1 during the forming process does not completely lie in one plane. In this case, the thickness of the clamp 7 is thicker in the region that contacts the thinner region 3 of the billet 1 than in the other region that is assigned to the thicker region 2 of the billet 1.

However, the thickness of the clamp 7 is not adapted to the shape of the billet 1 such that it corresponds to the thickness transition 4 of the not yet formed billet 1. In this case, the thickness of the clamp 7 is adapted such that it corresponds to the thickness transition 4 to be realized on the formed billet 1. In this respect, the difference in thickness between the thick region of the clamp 7 and the thin region of the clamp 7 is essentially twice as large as the difference in height between the thick region 2 and the thin region 3 of the billet 1 on one side. In other words, the clamp 7 is realized thinner in its thinner region than in its thicker region by an amount that corresponds to the difference in thickness between the thick region 2 and the thin region 3 of the billet 1.

Due to this measure, it is possible to take into consideration that the thickness transition 4 that originally existed on both sides is transferred to one side, namely the inner side of the deep-drawn component in this case, during the forming process of the billet 1. This essentially also applies to the die 5, the forming surface of which is analogously adapted to the thickness transition 4 to be realized. The cross section shown in FIG. 2A also indicates that the width of the die 5 changes in the longitudinal direction. This means that, when the die 5 is inserted into the opening of the female mold 6, the distance between the die 5 and the female mold 6 is smaller in the regions in which the die 5 has a greater width in the longitudinal direction than in the regions in which the die 5 has a lesser width in the longitudinal direction. This larger distance between the die 5 and the female mold 6 is required because this intermediate space needs to accommodate the thicker region 2 of the billet 1 during the forming process in which the thickness transition 4 that originally existed on both sides is transferred to the inner side of the formed billet 1.

FIG. 2B shows a formed billet 1 that was manufactured with the device in accordance with the first preferred embodiment of the invention which is schematically illustrated in FIG. 2A. FIG. 2B shows that the outer surfaces of the formed billet 1 are completely planar, and that the inner surfaces of the formed billet 1 contain a thickness transition 4 that connects a thicker region 2 of the billet with a thinner region 3 of the billet 1.

FIG. 3A schematically shows a device in accordance with a second preferred embodiment of the invention which makes it possible to form a billet 1' in such a way that the outer surfaces contain a thickness transition 4 and the inner surfaces of the formed billet are completely planar as shown in FIG. 3B. In accordance with the second preferred embodiment of the invention, the thickness transitions 4 that originally existed on both sides of the billet 1' should be transferred in such a way that a thickness transition 4 is only realized on the lower side of the billet 1. Consequently, the invention proposes that the surface of the clamp 7' which contacts the billet 1 during the forming process, i.e., the forming surface of the holding-down appliance, and the surface of the die 5 which presses against the billet 1, i.e., the forming surface of the die 5, respectively lie completely in one plane.

However, the forming surface of the female mold 6' that contacts the billet 1 during the forming process does not completely lie in one plane, but rather has a shape that is adapted to the thickness transition 4 to be realized; see, FIG. 3C. In this respect, the die 5 has, with the exception of the rounded edges, an essentially rectangular shape while the opening formed in the female mold 6 has a greater width in the longitudinal direction in a first region than in a second region. In this case, the first region is assigned to the thinner region 3 of the billet 1 and the second region is assigned to the thicker region 2 of the billet 1. This shape of the female mold 6 is required because the inner surface of the female mold 6 which limits this opening also acts as a forming surface of the female mold 6 when the billet 1 is pressed into the opening of the female mold 6. The function of the device in accordance with the second preferred embodiment of the invention which is schematically illustrated in FIG. 3A is analogous to the device for carrying out the method in accordance with the first preferred embodiment of the invention.

Although both preferred embodiments of the invention were described based on a deep-drawing method, the utilization of the device in accordance with the invention is not limited to such a method, i.e., the device in accordance with the invention is also suitable for other forming methods, e.g., high-pressure sheet forming methods or tension and compression forming methods.

While various embodiments in accordance with the present invention have been shown and described, it is understood that the invention is not limited thereto. These embodiments may be changed, modified and further applied by those skilled in the art. Therefore, this invention is not limited to the details shown and described previously but also includes all such changes and modifications which are encompassed by the appended claims.

What is claimed is:

1. A device for forming a component from a metal billet having at least two different thicknesses and a thickness transition therebetween on both of top and bottom surfaces of the billet, the thickness transition being transferrable to one side of the billet such that one of top and bottom surfaces of the formed component includes a thickness transition and the other of the top and bottom surfaces of the formed component is planar, said device comprising:

a first forming section and a second forming section which is positioned opposite to said first forming section, said first and second forming sections mutually cooperating with one another to deform the billet therebetween, wherein said first forming section has a forming surface which is adapted to form the thickness transition on the formed component, and the second forming section is adapted to form the planar surface on the formed component.

2. The device in accordance with claim 1, wherein said first forming device comprises a die and said second forming device comprises a female mold.

3. The device in accordance with claim 2, further comprising a clamp for holding the billet to said female mold, said clamp being adapted to cooperate with the female mold to hold down the billet and being mountable on a surface of the billet which corresponds to the die.

4. The device in accordance with claim 3, wherein surfaces of said clamp and said die which contact the billet are shaped in the form of the thickness transition.

5. The device in accordance with claim 3, wherein a surface of said mold which contacts the billet has a planar shape.

6. The device in accordance with claim 3, wherein surfaces of said clamp and said die which contact the billet are planar.

7. The device in accordance with claim 6, wherein a surface of said mold which contacts the billet is shaped in the form of the thickness transition.

8. The device in accordance with claim 7, wherein the female mold has an annular wall surrounding an opening into which said die is insertable, and wherein said annular wall forms the surface of said mold which contacts the billet.

9. A method for forming a component from a metal billet, the billet having at least two different thicknesses and a thickness transition therebetween on top and bottom surfaces of the billet, said method comprising the steps of:

providing a first forming section and a second forming section which is positioned opposite to said first forming section;

mounting the billet between said first forming section and said second forming section;

engaging said first forming section with said second forming section so as to form the said component from the billet;

wherein, during said engaging step, the thickness transition one side of the billet is transferred to the other side of the billet such that one of a top and bottom surface of the formed component includes a thickness transition and the other of said top and bottom surface of the formed component is planar.

10. The method in accordance with claim 9, wherein said first forming section has a forming surface which is adapted to form the thickness transition in the billet and said second forming section is adapted to form the planar surface in the billet.

11. The method in accordance with claim 10, wherein said first forming device comprises a die and said second forming device comprises a female mold.

12. The method in accordance with claims 11, further comprising the step of providing a clamp for holding the billet to said female mold for performing the mounting step, said clamp cooperating with the female mold to hold down the billet and being mountable on a surface of the billet which corresponds to the die.

13. The method in accordance with claim 12, wherein surfaces of said clamp and said die shaped in the form of the thickness transition are used to contact the billet.

14. The method in accordance with claim 13, wherein a surface of the mold used to contact the billet is planar.

15. The method in accordance with claim 13, wherein the female mold has an annular wall surrounding an opening into which said die is insertable, and wherein said annular wall forms the surface of said mold used to contact the billet.

16. The method in accordance with claim 12, wherein surfaces of said clamp and said which have a planar shape are used to contact the billet.

17. The method in accordance with claim 16, wherein a surface of said mold which is used to contact the billet is shaped in the form of the thickness transition.

* * * * *